United States Patent [19]

Stahlecker

[11] Patent Number: 4,559,774

[45] Date of Patent: Dec. 24, 1985

[54] YARN PIECING ARRANGEMENT FOR AN OPEN-END FRICTION SPINNING MACHINE

[75] Inventor: Fritz Stahlecker, Josef-Neidhart-Strasse 18, 7347 Bad Überkingen, Fed. Rep. of Germany

[73] Assignees: Hans Stahlecker; Fritz Stahlecker, both of Fed. Rep. of Germany

[21] Appl. No.: 611,087

[22] Filed: May 17, 1984

[30] Foreign Application Priority Data

May 19, 1983 [DE] Fed. Rep. of Germany ..... 3318266

[51] Int. Cl.[4] ..... D01H 15/02

[52] U.S. Cl. ..... 57/263; 57/22

[58] Field of Search ..... 57/202, 22, 261, 263, 57/401, 411, 413

[56] References Cited

U.S. PATENT DOCUMENTS 4,202,163 5/1980 Turk et al. ..... 57/401
4,327,545 5/1982 Fehrer ..... 57/401 X
4,367,623 1/1983 Parker et al. ..... 57/263
4,392,343 7/1983 Parker et al. ..... 57/401

*Primary Examiner*—Donald Watkins
*Attorney, Agent, or Firm*—Barnes & Thornburg

[57] ABSTRACT

A yarn piecing arrangement is disclosed for an open end friction spinning machine of the type having two friction rollers rotatably drivable in the same direction and disposed adjacent one another to form a yarn forming wedge-shaped gap therebetween, fiber supplying means for supplying individual fibers to the wedge-shaped gap, yarn withdrawal means for withdrawing spun yarn in the direction of the wedge-shaped gap, and suction device means for applying suction forces to hold the spinning yarn in the wedge-shaped gap. In order to facilitate fine control of the yarn piecing process, the friction rollers are stopped before the spun yarn end section is returned to the wedge-shaped gap. Once the yarn end section is positioned at the wedge-shaped gap, the rollers are restarted and yarn piecing is carried out.

28 Claims, 9 Drawing Figures

YARN PIECING ARRANGEMENT FOR AN OPEN-END FRICTION SPINNING MACHINE

BACKGROUND AND SUMMARY OF THE INVENTION

This invention relates to a process and a device for carrying out the process for piecing a yarn at a spinning unit of an open-end friction spinning machine. The spinning unit has two rollers that are drivable in the same rotational direction and are arranged next to one another to form a wedge-shaped gap or slot. A feeding and opening device is provided for the feeding of single fibers to the wedge-shaped gap. A yarn withdrawal device is provided for drawing off the formed yarn or thread in the direction of the extension of the wedge-shaped gap and a suction device is provided for holding the forming yarn in the wedge-shaped gap. For the joining or piecing of the yarn, an already spun end section of the yarn is returned to the wedge-shaped gap and the previously interrupted feeding of the fibers is resumed and the yarn end section withdrawn.

In the case of a known process of the intially mentioned type, disclosed in European Published Application (EPOS) No. 34 427, the end section of the yarn is sucked back into the not opened spinning unit by means of a vacuum and is brought into the range of the wedge-shaped gap and is then transferred to the gap. In this case, a yarn length is furnished that is dimensioned in such a way that the end of the yarn end section is disposed in the area of the feeding point where the fibers are fed. Then the previously interrupted feeding of the fibers is resumed after which the yarn is withdrawn. In this arrangement, the end section of the yarn is located in the wedge-shaped gap of the turning rollers during a certain time period after the switching-on of the feeding mechanism before it is again withdrawn. Thus the end section of the yarn receives an increased twist so that the length portion containing the yarn piecing or connection differs from the remaining length of the yarn. It does not seem possible by means of this process to obtain a yarn piecing that can remain in the finished yarn for further processing.

The invention is based on the objective of providing a process and a device of the initially mentioned type by means of which an improved yarn piecing can be obtained.

This objective is achieved according to the invention by stopping the rollers for the piecing process, by inserting the end section of the yarn into the wedge-shaped gap of the stopped rollers and by subsequently switching on the feeding mechanism for the fibers, and again activating the drive of the rollers and the drive of the yarn withdrawal device. By means of these measures, it is first achieved that the return of the end section of the yarn to the wedge-shaped gap is simpler and more reliable, in which case the returned end section of the yarn is also not overtwisted. Since, when the drive of the rollers is turned back on, these rollers do not suddenly reach their normal speed but reach that speed after a certain starting delay, there is also a certain period of time during which it is possible to carry out a suitable feeding of the fibers and a suitable withdrawal again of the yarn, which further improves the quality of the yarn piecing.

In a useful development of the invention, it is provided that the end of the yarn is returned beyond the area of the feeding point of the fibers and that the yarn withdrawal device is switched on before the feeding of the fibers. This makes it possible to also here provide sufficient time periods in order to carry out the steps of the process in a controlled manner. It is useful that the feeding of the fibers and the restarting of the rollers is initiated approximately simultaneously. Since the fibers reach the wedge-shaped gap only with a certain delay after the feeding mechanism is switched back on, and since the rollers also start with a certain delay, there is good coordination of these steps with this arrangement.

In an advantageous development of the invention, it is also provided that the switching-on of the feeding mechanism is coordinated with the drawing off of the end section of the yarn in such a way that the fed fibers will arrive in the wedge-shaped gap at that point in time when the extreme end of the yarn end section reaches the area of the feeding point. Thus it is possible to largely avoid thick sections in the yarn at the piecing connection.

In a further development of the invention, it is provided that the part of the yarn end section that is returned beyond the length of the wedge-shaped gap is guided in a guide in such a way that the end of the yarn end is not transferred to the wedge-shaped gap until it reaches the area of the feeding point. In this manner, it is insured that the end of the yarn end section does not receive excess twisting and is thus in a condition that is favorable for the piecing operation. In this arrangement, it is especially advantageous that the yarn end section in the area that faces away from the withdrawal direction of the yarn, is guided on a path that is at least approximately identical with the last section of the path of the fed fibers. The end of the yarn end section therefore, before the doubling or twisting into the new yarn, carries out a movement that is essentially identical with the movement of the fed fibers so that an even or smooth yarn piecing is obtained.

In a further development of the invention, it is provided that the feeding mechanism for the fibers is first switched on with an amount of fibers that is decreased in comparison to the normal spinning operational amount and is subsequently increased to the operational amount when the end of the yarn end has passed the feeding point. This also facilitates influencing the shape of the yarn piecing and improving it with respect to quality. For the same purpose, it is also advantageous that the withdrawing of the yarn, during the joining or piecing process, takes place at a speed that is different from the operational yarn withdrawal speed. In order to achieve a connection between the end of the yarn end section and the newly fed fibers that is as intensive as possible, it is advantageous that the end of the yarn end section is worked into a type of tuft or fiber beard before the switching-on of the thread pull-off device. This ensures a very close connection between the newly fed fibers and the tufted end of the yarn.

Further objects, features, and advantages of the present invention will become more apparent from the following description when taken with the accompanying drawings which show, for purposes of illustration only, an embodiment constructed in accordance with the present invention.

BRIEF DESCRIPTION OF THE DRAWINGS

FIG. 8 is a partial sectional view corresponding to FIGS. 3 to 7, depicting the machine elements and yarn after the roller drive is switched on again and the fiber feeding mechanism is switched on.

DETAILED DESCRIPTION OF THE DRAWINGS

Figure 1:
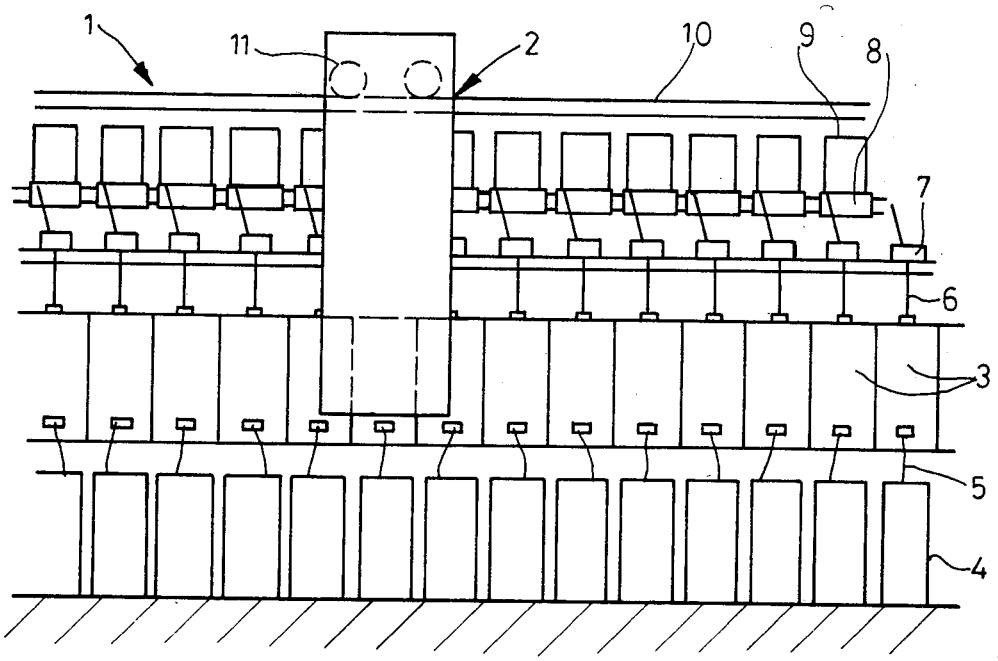
FIG. 1 is a front schematic view of a part of an open-end friction spinning machine with a maintenance device that can be moved in longitudinal direction of the machine, constructed in accordance with the present invention.
Figure 2:
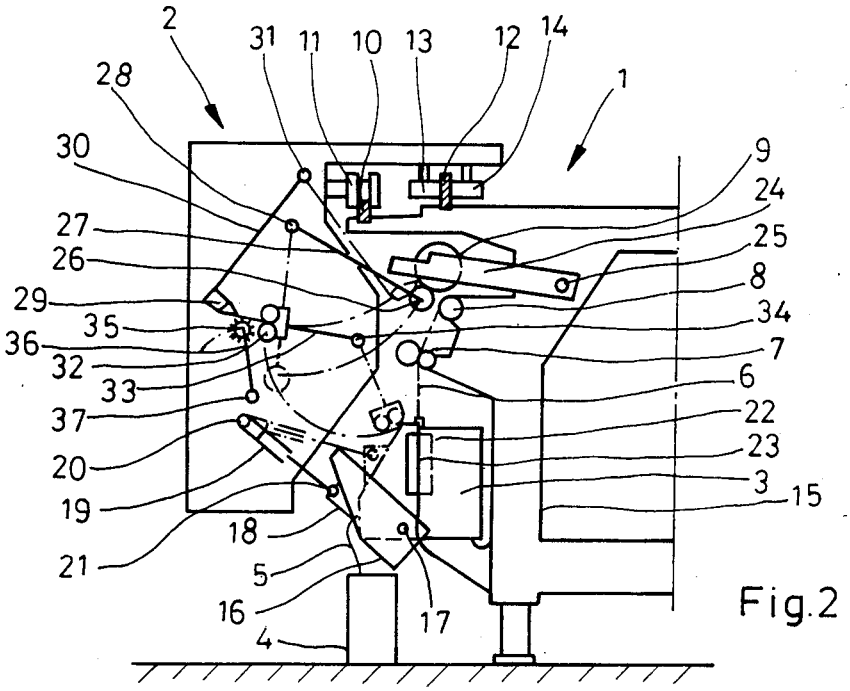
FIG. 2 is a diagrammatical sectional view through the open-end friction spinning machine of FIG. 1 showing the maintenance device carrying out a yarn piecing process.
Figure 3:
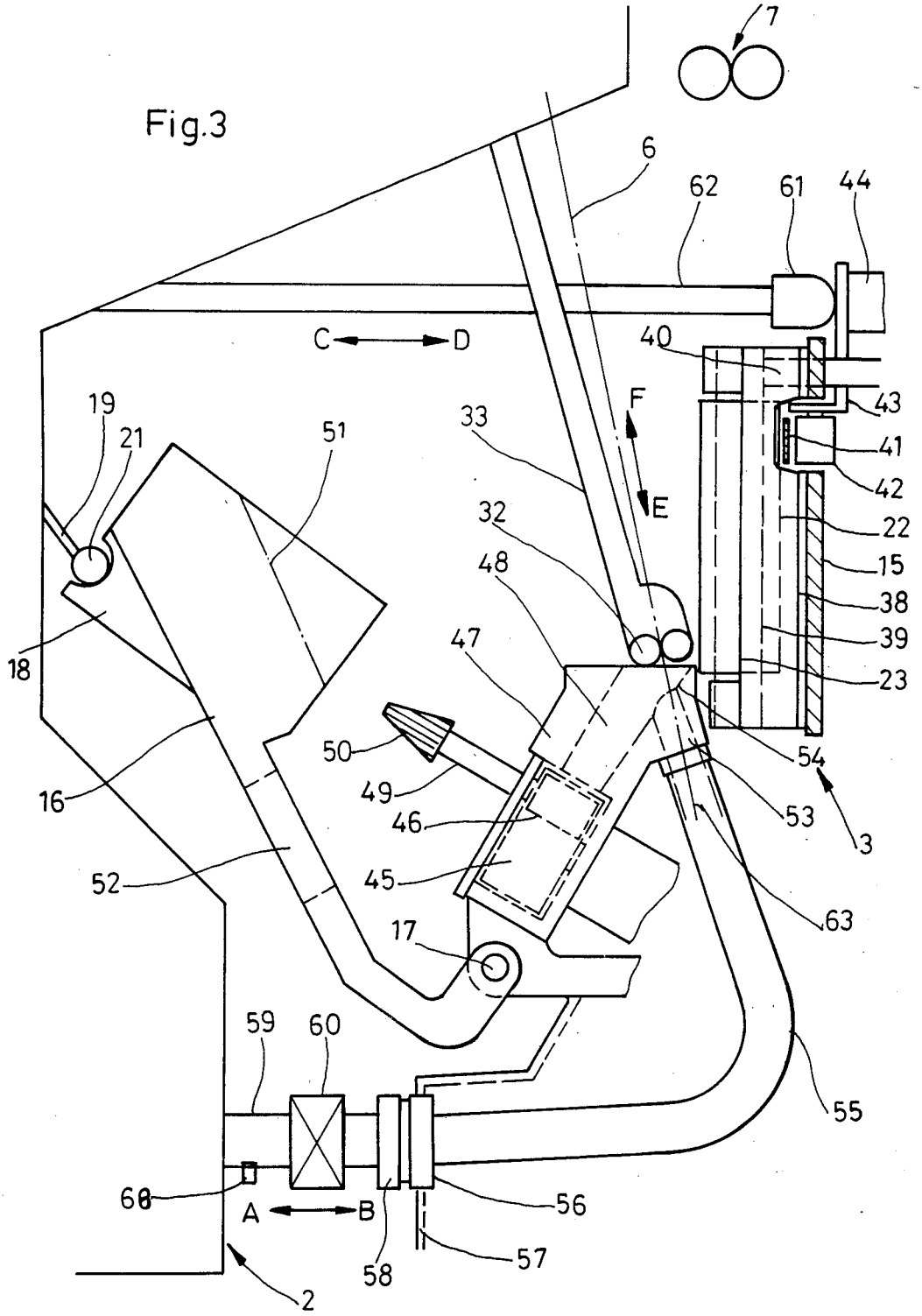
FIG. 3 is an enlarged partial sectional view of a portion of FIG. 2, depicting an opened spinning unit during the first phase of the return of the yarn end section for piecing.

An open-end friction spinning machine 1 (FIGS. 1 and 2) has a plurality of spinning aggregates or units that are constructed identically with respect to one another and are arranged in a row next to one another on one or both sides of the machine. A maintenance device or unit 2 is drivably guided for movement along the open-end friction spinning machine 1 by means of running wheels 11, 13, and 14 on rails 10 and 12 mounted on a machine frame 15. The maintenance device 2, in a known manner, can, after a yarn breakage is detected, be brought to a spinning aggregate 3 for carrying out a yarn piecing process.

For each spinning unit 3, a can 4 with a sliver 5 is provided. Sliver 5 is taken out of the can 4 by means of a feeding and opening device which unravels and opens the sliver 5 into individual fibers which are fed to the wedge-shaped gap 23 between the two rollers 22 that are arranged next to one another and are driven in the same rotational direction. In the wedge-shaped gap 23 of the rollers 22, the fibers are twisted into a thread or yarn 6 that is drawn off in the direction of the extension of wedge-shaped gap 23 by means of a pair of yarn withdrawal rollers 7. Subsequently, the yarn 6 is wound on a winding spool 9 driven by a grooved drum 8. The winding spool 9 is held by a spool holder 24 that can be swivelled away from the grooved drum 8 around a shaft 25.

The movable maintenance device 2 that is adjustably moved to a spinning unit 3 contains a lift-off roller 26 by means of which the winding spool 9 is lifted off the grooved drum 8. The lift-off roller 26, which can be driven in both rotating directions in a manner not shown in detail, is arranged on a swivel arm 27 that can be swivelled around a shaft 28. The maintenance device 2 also contains a suction nozzle 29 that is adjustably moved to the lifted-off winding spool 9 and searches for the wound broken yarn end. In this case, it is practical if the winding spool 9 is driven by the lift-off roller 26 against its winding direction. The suction nozzle 29 is arranged on an arm 30 that can be swivelled around a shaft 31. The suction nozzle 29, with the yarn taken up by it, is swivelled away from the winding spool 9. The yarn end then arrives in the area of a yarn clamp 32 having two clamping rollers arranged on an arm 33 that can be swivelled around a shaft 34. As will be explained later, the arm 33 can also be adjusted in its axial direction, for which purpose, it may, for example, be formed like a telescope. The two clamping rollers of the thread clamp 32 that can be moved toward one another and away from one another, are provided with a rotating drive that can be driven in both directions.

The maintenance device 2 also has a separating disk 35 that can be adjustably moved to the yarn end 6 between the suction nozzle 29 and the yarn clamp 32, said separating disk 35 being arranged on an arm 36 that can be swivelled around a shaft 37. By means of the driven separating disk 35, the yarn end 6 is separated at a predetermined distance from the thread clamp 32 and is unravelled into a type of tuft in such a way that the end of the yarn end 6 forms this tuft which has practically no more spinning twist.

The maintenance device 2 also has a mechanism for opening the spinning unit aggregate, such as a hydraulic press 19 that can be swivelled around a shaft and by means of a spherical head 21 can be adjustably moved to a receiving piece 18 of a lid-type component 16 of the spinning unit 3 that can be swivelled around a shaft 17. By swinging away the lid-type component 16 (FIG. 2), the area of the wedge-shaped gap 23 of the rollers 22 is exposed so that the yarn end 6 that is to be returned in a simple manner can be supplied back into the area of the wedge-shaped gap 23.

As shown in FIGS. 3 to 9, the two rollers 22 of each spinning unit 3 are driven by means of a tangential belt 41 passing through in longitudinal direction of the machine and driving the rollers 22 of all spinning units 3 of one side of the machine. In the area of the rollers 22, the tangential belt 41 is loaded by means of a tension roller 42 and is pressed against the circumference of the rollers 22. The tension rollers are held by means of retainers 43 which are carried by means of tension springs 44, such as leaf springs. The tangential belt 41 is guided in such a way that it detaches itself from the circumference of the rollers 22 so that these can be stopped when the respective tension rollers 42 are disengaged. In order to accelerate the stopping, an additional braking system can be provided in a manner that is not shown in detail and that suitably is connected with the retainers 43 of the tension rollers 42 in such a way that, when the tension rollers 42 are lifted off, both rollers 22 of a spinning aggregate 3 receive a braking force.

In the case of the shown embodiment, at least one of the two rollers 22 is formed as a so-called suction roller. It has a perforated shell and a suction insert 39 located on its inside which aims at the area of the wedge-shaped gap with its suction slot. The suction insert 39, consisting of a tube that is closed at both ends, is connected to a vacuum pipe 40. The roller 22, in a manner that is not shown in detail, can be disposed on the suction insert 39 by means of roller bearings. The tube-shaped suction insert 39 is clamped into a bearing housing with its two ends, which housing itself is fastened at the machine frame 15. Especially the roller 22 turning into the wedge-shaped gap 23 is developed as a suction roller. The second roller 22 of the spinning aggregate 3 can be developed in a corresponding manner. However, a roller may also be used that has a closed surface area which is provided with a profiling or covering as needed to facilitate air flow. Two rollers 22 having closed profiled surface areas may also be used in the appropriate air guide profiling, in which case a suction device is then provided that acts upon the area of the wedge-shaped gap 23 from the rear (side opposite the yarn).

As the feeding and opening device, a device may, for example, be used that is generally know from open-end rotor spinning machines. This feeding and opening device has a feeding roller 46 which interacts with a feeding table that is not shown and which, together with the feeding table, offers the sliver to a much faster rotating opening roller 45 which is provided with a set of needles or teeth and by means of which the sliver is unraveled and opened into individual fibers which, via a fiber feeding duct 48, 51 starting at the opening roller 45, are transported into the area of the wedge-shaped gap 23 of the rollers 22. The first part 48 of the fiber feeding duct is located in a stationary housing 47 in which the feeding roller 46 and the opening roller 45 are housed. At this stationary housing 47, the lid-type component 16 is disposed so that it can be swivelled around a shaft 47, said lid-type component 16 containing the part 51 of the fiber feeding duct that leads to the rollers 22. This part 51 consists of a slit-shaped recess that is open in the direction of the rollers 22.

Before the yarn end section 6 that was taken off the winding spool 9 and was tufted (see description concerning FIG. 2) is returned to the spinning unit 3, the spinning unit 3 is opened by means of the hydraulic press 19, by swivelling away the lid-shaped component, so that the area of the wedge-shaped gap is exposed. In this case, a yarn receiving device is also exposed which consists of a suction nozzle 53. The suction nozzle 53 is located in the housing 47 and opens up in the first part 48 of the fiber feeding duct. The suction nozzle 53, via a suction pipe 55, is connected with a connection 56 which is arranged in the area of the front side of the spinning unit 3, for example, in a casing wall 57. A connecting piece 58 of the maintenance device 2 can be added to the connecting piece 56, said connecting piece 58 being developed in such a way that at the time of the adjusting and coupling, a self-locking means of the connecting piece 56 is opened. The connecting piece 58, while being movable in the direction of the arrows A and B, is connected to a vacuum pipe 59 containing an on-off valve 60 and can be adjustable moved to the connecting piece 56. The vacuum pipe 59 in a manner that is not shown in detail, is connected with a vacuum source of the maintenance device 2.

Figure 4:
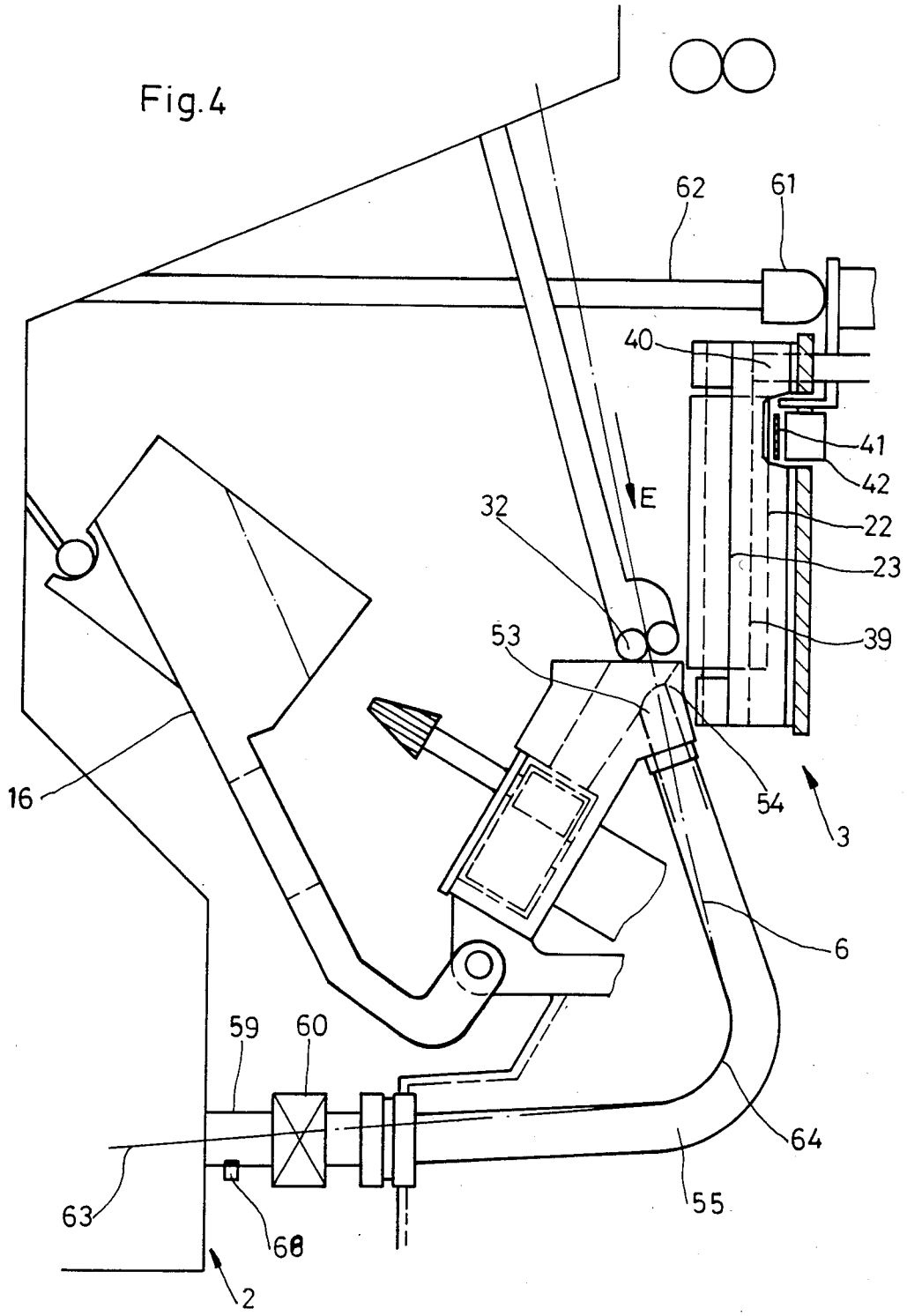
FIG. 4 is a partial sectional view corresponding to FIG. 3, depicting the machine elements and yarn after the conclusion of the return of the yarn end section.
Figure 5:
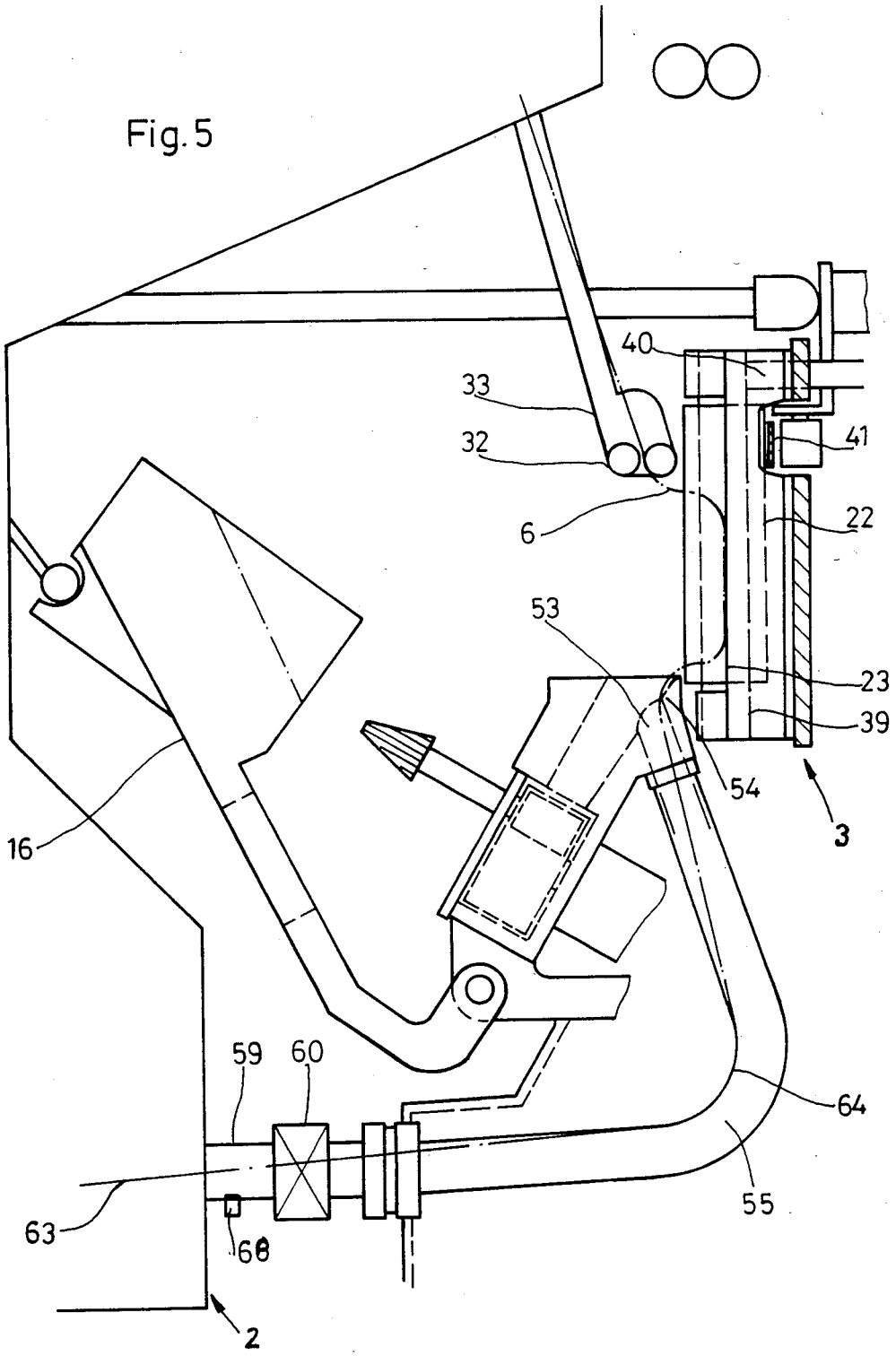
FIG. 5 is a partial sectional view corresponding to FIGS. 3 and 4, depicting the machine elements and yarn during the transfer of the yarn end section to the wedge-shaped gap of the rollers.

After the yarn end 6 is cut to length by means of the separating disk 35 (FIG. 2), and the end 63 of the yarn end 6 is made into a type of tuft, the yarn clamp 32 is swivelled to the spinning aggregate 3 and is adjustably moved to the area of the suction nozzle 53. By means of the drive of the clamping rollers of the yarn clamp 32 against the take-off direction, with the lift-off roller also being driven against the take-off direction, the yarn end section 6 is returned and inserted into the suction nozzle 53. After a certain length of the yarn end 6 has been returned, the further return is interrupted by stopping the clamping rollers of the thread clamp 32. The returned yarn end rests against a deflecting means 64 of the vacuum pipe 55 that is formed as a bend so that it is under a certain tension (FIG. 4). The interruption of the return is controlled by a device 68 which is arranged in the vacuum pipe 59 and which responds to the passing end 63 of the yarn end section 6.

No later than at the point in time when the return of the end of the yarn is completed, the rollers 22 will be stopped. For this purpose, the maintenance device 2 is provided with an adjusting arm 62 that can be moved in the direction of the Arrows C and D. The adjusting arm 52 utilizes an adjusting piece 61 pressing against the retainer 43 of the tension roller 42 to lift it off the tangential belt 41 so that belt 41 thus detaches itself from the rollers 22. If an additional brake is provided which then, by using a suitable lever system, can also be actuated by the adjusting piece 61, the stopping of the rollers can be accelerated.

Figure 6:
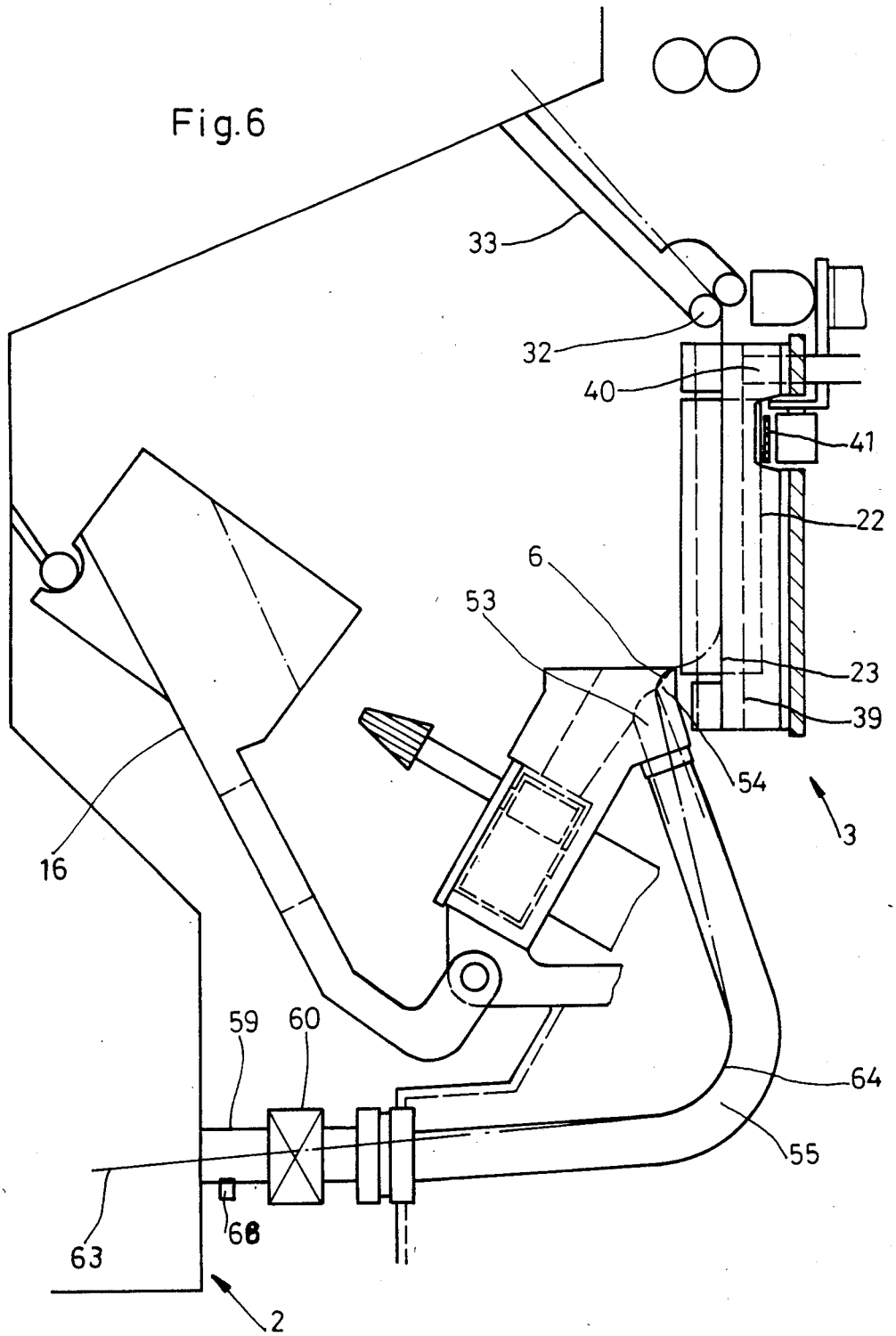
FIG. 6 is a partial sectional view corresponding to FIGS. 3 to 5 depicting the machine elements and yarn after the conclusion of the return of the yarn end section and the insertion of the yarn end section in the wedge-shaped gap.

After the return of the yarn end section 6 and the stopping of the rollers 22 which preferably took place beforehand, the yarn clamp 32 is moved into a position so that it comes to be located in the extension of the wedge-shaped gap 23 in the pull-off direction (FIG. 6). In the case of this adjusting movement, either the clamping rollers are moved apart so that the yarn clamp 32 is opened (FIG. 5), or continued to be driven against the pull-off direction. By this movement of the thread clamp 32, the yarn end section 6 is sucked into the wedge-shaped gap 23 (FIGS. 5 and 6), since the vacuum in the area of the wedge-shaped gap 23 is maintained.

Figure 7:
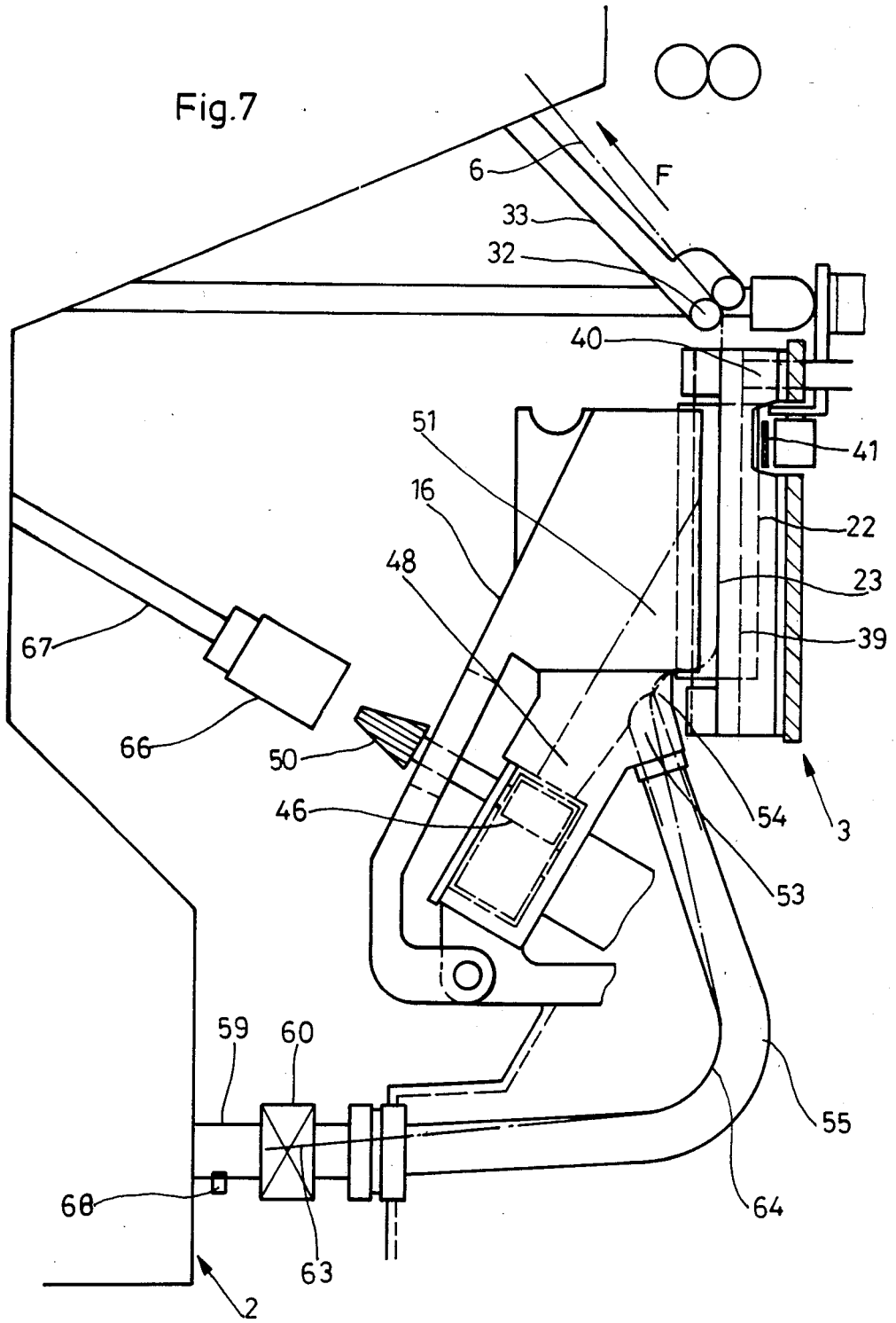
FIG. 7 is a partial sectional view corresponding to FIGS. 3 to 6, depicting the machine elements and yarn after the closing of the spinning unit and starting of the yarn withdrawal.
Figure 8:
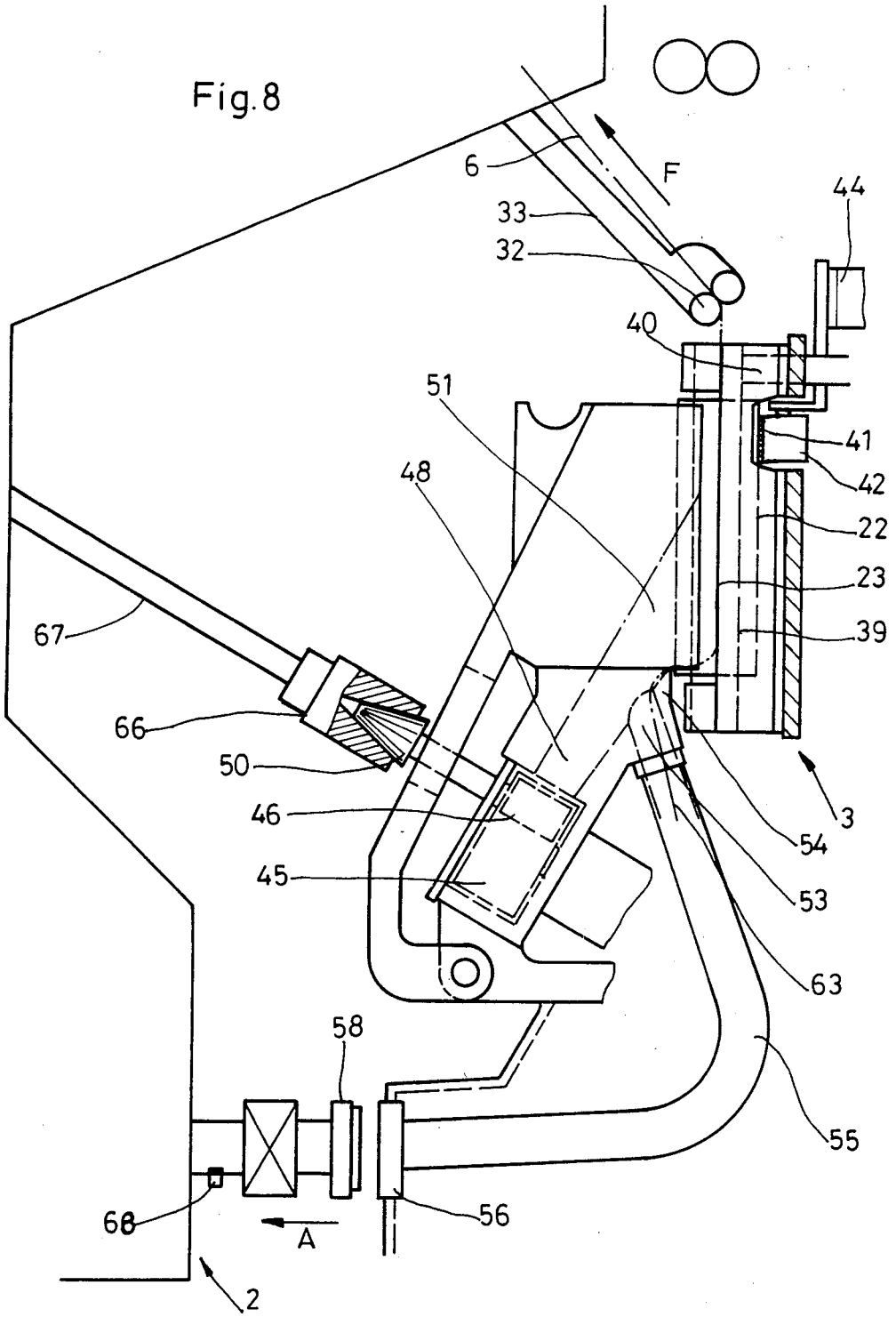
Figure 9:
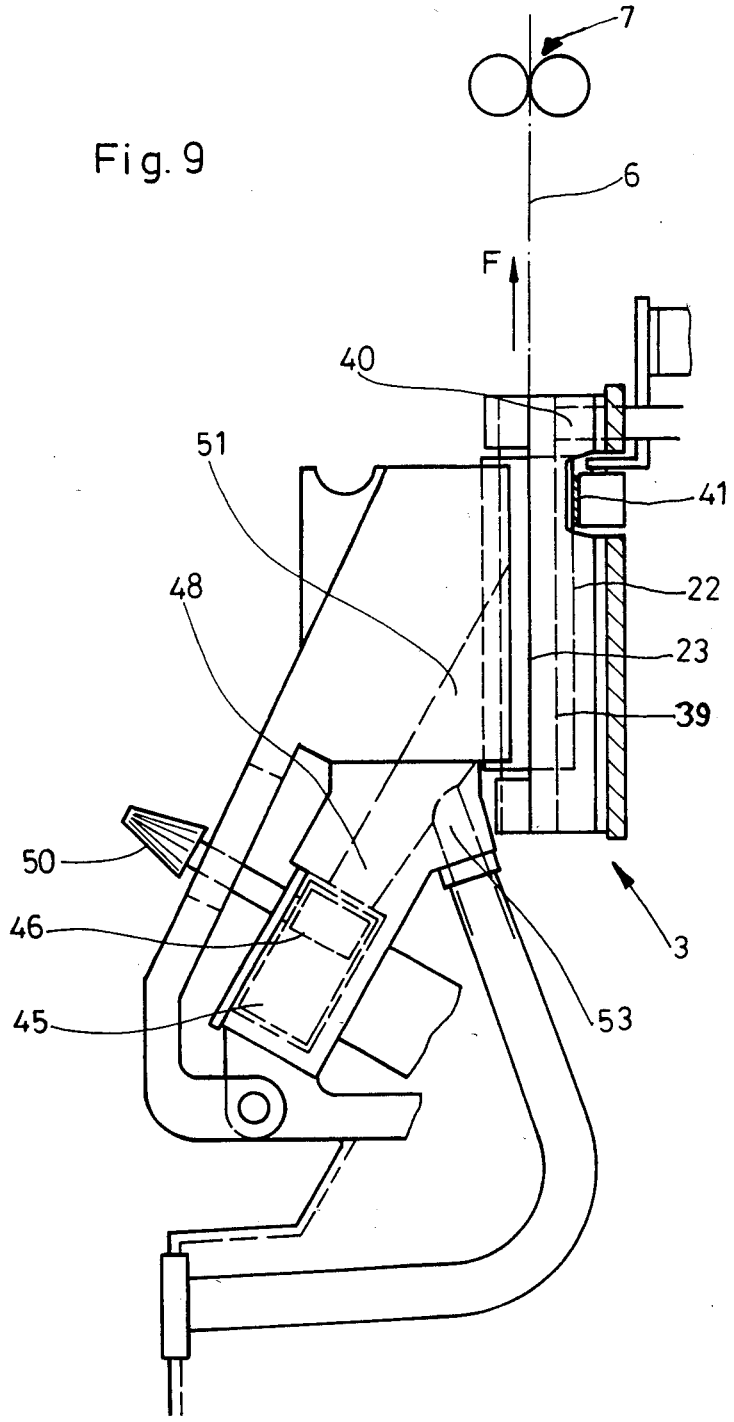
FIG. 9 is a partial sectional view corresponding to FIGS. 3 to 8, depicting the machine elements and yarn after the concluded piecing process, with the maintenance device moved away.

After the yarn end section 6 is placed in the wedge-shaped gap 23 of the stopped rollers 22, th lid-type component 16 is closed again (FIG. 7). After the spinning aggregate 3 is closed, the yarn end section 6 is drawn off again by switching on the clamping rollers of the thread clamp 32 in the yarn withdrawal direction and is wound on the winding spool 9 by switching on the lift-off roller 26 in the winding direction. In this case, the end 63 of the yarn end section 6 again passes through the area of the device 68 which then releases a corresponding signal to a program control means provided with time function elements, by means of which, as a function of this signal, the drive of the rollers 22 is switched on again by a new adjusting movement of the tension roller 42. In addition, by means of the program control, the fiber feeding is switched on in a coordinated manner. In this case, it should be added that the fiber feeding is switched off when a breakage of the thread occurs. For this purpose, a yarn breakage sensor is provided which is, for example, arranged in the area of the thread take-off device 7. The maintenance device 2 may be provided with a device which moves the yarn breakage sensor back into its operating position and thus switches on again the drive of the fiber feeding and unraveling device of the spinning unit 3. However, in the case of the shown embodiment, it is provided that the feeding during the piecing process is controlled by the movable maintenance device 2, in which case, an auxiliary drive is provided which, for this period of time, takes over the drive of the feeding roller 46, while the opening roller, the drive of which is normally not interrupted when the yarn breaks, continues to be driven by the drive of the machine. The maintenance device 2 is provided with an accessory drive source 67 which is provided with a connection piece 66 which can be slipped on a bevel wheel 50 of a shaft connected with the feeding roller 46 (FIGS. 7 and 8).

The renewed driving of the rollers 22 is delayed as long as it is technologically feasible, in order to avoid an overtwisting of the thread end section 6. This means that the rollers 22 will only be started again when the feeding is turned on and the fibers arrive in the area of the rollers 22. In this case, it is useful to first start the feeding with a reduced amount of fibers and to only feed the operational amount of fibers when the end 63 of the yarn end section 6 leaves the area of the opening of the fiber feeding duct (part 51). The reduced amount as well as the operational amount are selected in dependance on the fineness of the thread to be spun. The feeding of the fibers, with respect to time, is controlled in such a way that the fibers arrive in the area of the wedge-shaped gap 23 when the end 63 of the yarn end section 6 is also located in this area.

The suction nozzle 53 opens in the part 48 of the fiber feeding duct so that the end 63 of the yarn end section 6 extends along the wedge-shaped gap 23 and is lifted from the gap before the area of the feeding point. The yarn end therefore receives practically no twist before it actually reaches the area of the wedge-shaped gap 23. Since the suction nozzle 53 opens into the part 48 of the fiber feeding duct, the end section 63 of the yarn end section 6 and the fibers that are fed again take the same path to the wedge-shaped gap 23 so that they arrive in the wedge-shaped gap 23 in the same way. In this case, it is useful that the feeding of the fibers is coordinated in such a way that the fibers and the end 63 of the yarn end section 6 arrive at the wedge shaped gap 23 at the same time. The result will then be a very intensive mixing and twisting and thus a good connection between the end 63, which is preferably made into a type of fiber tuft, and the fed fibers.

Before the switching-on of the fiber feeding mechanism, the on-off valve 60 is closed so that the effect of the suction nozzle 53 is interrupted and the fiber transport is not interfered with.

After the joining or piecing has taken place, the yarn end section 6, in a way that is not described in detail, is transferred by known means of the maintenance device 2 to the yarn withdrawal device 7 which has continued at operational speed. In addition, the winding spool 9 is lowered to the grooved drum 8 that is driven in an unchanged manner. The yarn 6, taking up its normal yarn path, actuates the yarn monitoring sensor so that the operational yarn feeding means is switched on, i.e., the operational drive of the feeding roller 46 so that the accessory drive of the maintenance device 2 can be cancelled or disconnected. The maintenance device 2 can then leave the corresponding spinning unit 3 and again start its monitoring route.

In the foregoing description, the piecing process for eliminating a yarn breakage was described using one single spinning unit. A piecing process that is the same in principal may also be used for the starting (start spinning) of a complete open-end friction spinning machine. In that case, it will then be provided that the yarn end sections 6 that were spun earlier, according to the above descriptions, is inserted in the individual spinning units 3, in which case, however, the yarn withdrawal during the piecing is taken over by the operational withdrawal device 7 as well as the feeding of the fibers.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. A yarn piecing process for piecing a spun yarn end section with fibers being spun in an open-end friction spinning machine of the type having:

two friction rollers rotatably drivable in the direction and disposed adjacent one another to form a yarn forming wedge-shaped gap therebetween, fiber supplying means for supplying individual fibers to the wedge shaped gap, suction device means for applying suction forces to hold the spinning yarn in the wedge shaped gap, and yarn withdrawing means for withdrawing formed yarn from the wedge-shaped gap, said process comprising:

stopping the rotation of the friction rollers, placing the spun yarn end suction in the wedge shaped gap of the stopped rollers, and subsequently switching on the drive for the friction rollers, the fiber supplying means, and the yarn withdrawing means.

2. A process according to claim 1, wherein the fiber supplying means includes a fiber feed channel means with a feeding opening to the wedge-shaped gap, wherein said placing includes extending the extreme free end of the spun yarn end section beyond the area of the feeding opening in the direction opposite the yarn withdrawal direction, and wherein said switching includes switching on the yarn withdrawing means prior to switching on the fiber supplying means.

3. A process according to claim 1, wherein said switching includes simultaneous switching on of the drive for the friction rollers and the fiber supplying means.

4. A process according to claim 2, wherein said switching includes simultaneous switching on of the drive for the friction rollers and the fiber supplying means.

5. A process according to claim 2, wherein said switching includes coordinating the switching on of the fiber supplying means and of the yarn withdrawal means such that the fed fibers will arrive in the wedge-shaped gap when the free end of the yarn end section reaches the area of the feeding opening.

6. A process according to claim 2, wherein said placing includes maintaining the free end portion of the yarn end section extended beyond the area of the feeding opening in a guide in such a way that the free end portion is transferred to the wedge shaped gap only after it reaches the feeding opening.

7. A process according to claim 6, wherein said placing includes guiding the yarn end section portion extended beyond the feeding opening to have a path to the wedge shaped gap which is substantially identical to the path of the fibers fed to the wedge-shaped gap.

8. A process according to claim 2, wherein said switching includes first switching on the fiber supplying means to supply a predetermined amount of fibers lower than for normal operating conditions and later switching the fiber supplying means to supply an amount for normal operating conditions when the free end of the yarn end section passes the feeding opening as it moves in the yarn withdrawal direction.

9. A process according to claim 6, wherein said switching includes first switching on the fiber supplying means to supply a predetermined amount of fibers lower than for normal operating conditions and later switching the fiber supplying means to supply an amount for normal operating conditions when the free end of the yarn end section passes the feeding opening as it moves in the yarn withdrawal direction.

10. A process according to claim 1, wherein said switching includes operating the yarn withdrawal means at a different speed for piecing operations than for normal spinning operations.

11. A process according to claim 9, wherein said switching includes operating the yarn withdrawal means at a different speed for start spinning operations than for normal spinning operations.

12. A process according to claim 1, further comprising working the extreme free end of the yarn end section into a type of fiber tuft before returning said free end for yarn piecing.

13. Apparatus for piecing yarn by joining a spun yarn end section to fibers being spun in an open-end friction spinning machine of the type having:

two friction rollers rotatably drivable in the same direction and disposed adjacent one another to form a yarn forming wedge-shaped gap therebetween, fiber supplying means for supplying individual fibers to the wedge shaped gap, suction device means for applying suction forces to hold the spinning yarn, in the wedge shaped gap, and yarn withdrawing means for withdrawing formed yarn from the wedge-shaped gap, said apparatus further comprising:

roller stopping means for stopping the rotation of the friction rollers, yarn placing means for placing the spun yarn end section in the wedge shaped gap of the stopped rollers, and switch control means for switching on the drive for the friction rollers, the fiber supplying means, and the yarn withdrawing means after the yarn placing means have placed the spun yarn end section in the wedge-shaped gap.

14. Apparatus according to claim 13, wherein a plurality of commonly driven spinning units are provided, and wherein each spinning unit is equipped with roller stopping means including individually movable means for stopping the rollers.

15. Apparatus according to claim 14, wherein the yarn placing means includes:

a yarn receiving device located in the vicinity of the wedge shaped gap that faces away from the yarn withdrawal direction.

a yarn clamp for clamping the end of the spun yarn, and yarn clamp moving means for moving the yarn clamp to the yarn receiving means to accomodate transfer of part of the yarn end section to the yarn receiving device.

16. Apparatus according to claim 15, wherein said yarn clamp means includes means moving the yarn clamp into a position extending along the wedge shaped gap after the free end of the yarn end section is received by the yarn receiving device, whereby the yarn is held extended between the yarn clamp and the yarn receiving means adjacent the wedge shaped gap.

17. Apparatus according to claim 16, wherein said yarn clamp includes two clamping rollers which are rotatably driven in both directions and are disposed to clamp the yarn therebetween, said clamping roller being supported on a movable arm member.

18. Apparatus according to claim 15, wherein said yarn receiving means includes a suction nozzle connectible with a suction source.

19. Apparatus according to claim 17, wherein said yarn receiving means includes a suction nozzle connectible with a suction source.

20. Apparatus according to claim 18, wherein said fiber supplying means includes a fiber feed channel means with a fiber feeding opening and wherein said suction nozzle is arranged in the area of the feeding opening.

21. Apparatus according to claim 15, wherein said fiber supply means includes fiber feed channel means having fiber feeding openings at its end nearest the wedge-shaped gap, wherein a part of the fiber feed channel means including said fiber feeding opening is disposed in a movable lid type component that partially covers the rollers, and wherein lid moving means are provided for moving the lid type component to a position exposing the wedge-shaped gap and the yarn receiving device.

22. Apparatus according to claim 15, wherein an adjustably movable maintenance device is provided for selectively performing maintenance operations at individual spinning units, said maintenance device including actuating device means for controlling the roller stopping means and for controlling operation of the yarn clamp.

23. Apparatus according to claim 22, wherein said maintenance device includes:

yarn end seeking means for seeking the spun yarn end section, yarn cutting means for cutting the yarn end section to predetermined length, and yarn end transfer means for transferring the yarn end section to the yarn clamp.

24. Apparatus according to claim 23, wherein said fiber supply means includes fiber feed channel means having fiber feeding openings at its end nearest the wedge-shaped gap, wherein a part of the fiber feed channel means including said fiber feeding opening is disposed in a movable lid type component that partially covers the rollers, and wherein lid moving means are provided for moving the lid type component to a position exposing the wedge-shaped gap and the yarn receiving device.

25. Apparatus according to claim 24, wherein said maintenance device includes means for controlling the lid moving means.

26. Apparatus according to claim 22, wherein the maintenance device is provided with an accessory drive for selectively driving a feeding roller of the fiber supplying means of a spinning unit.

27. Apparatus according to claim 18, wherein an adjustably movable maintenance device is provided for selectively performing maintenance operations at individual spinning units, wherein the suction nozzle is connected via a suction pipe means to a connection at the spinning unit, which connection is also selectively connectible with a vacuum pipe of the maintenance device, and wherein said maintenance device contains a switching control valve for selectively communicating the vacuum pipe to effect return of the yarn end into the suction nozzle.

28. Apparatus according to claim 27, wherein the maintenance device includes a yarn end detection device for detecting the extreme free end of the yarn end section, said yarn end detection device being operable for sending a signal to a program control means that controls at least one of the switching on of the fiber supplying means, the restarting of the rollers and the drive of clamping rollers of the yarn clamp.

* * * * *